US010391356B2

(12) United States Patent
Davis

(10) Patent No.: US 10,391,356 B2
(45) Date of Patent: Aug. 27, 2019

(54) STUDIOS, DEVICES AND METHODS FOR EXERCISING OR IMPROVING POSTURE

(71) Applicants: Jennifer Marie Davis, Lafayette, CA (US); THE VERTICAL METHOD LLC, Lafayette, CA (US)

(72) Inventor: Jennifer Marie Davis, Lafayette, CA (US)

(73) Assignee: The Vertical Method LLC, Lafayette ( * ) Notice: Subject to any disclaimer, the term of this patent is extended or adjusted under 35 U.S.C. 154(b) by 196 days.

(21) Appl. No.: 15/116,209

(22) PCT Filed: Jan. 30, 2015

(86) PCT No.: PCT/US2015/014000
§ 371 (c)(1),
(2) Date: Nov. 7, 2016

(87) PCT Pub. No.: WO2015/117044
PCT Pub. Date: Aug. 6, 2015

(65) Prior Publication Data

US 2017/0056718 A1 Mar. 2, 2017

Related U.S. Application Data

(60) Provisional application No. 61/934,768, filed on Feb. 1, 2014.

(51) Int. Cl.
*A63B 1/00* (2006.01)
*A63B 7/00* (2006.01)
(Continued)

(52) U.S. Cl.
CPC ..... *A63B 23/0238* (2013.01); *A63B 1/00* (2013.01); *A63B 7/00* (2013.01); *A63B 21/04* (2013.01);
(Continued)

(58) Field of Classification Search
CPC ..... A63B 21/0442; A63B 21/0557
See application file for complete search history.

(56) References Cited

U.S. PATENT DOCUMENTS 5,042,615 A * 8/1991 Anderson ..... E04G 1/20 182/136
5,046,724 A * 9/1991 Sotomayer ..... A63B 69/20 482/90
(Continued)

OTHER PUBLICATIONS https://www.youtube.com/watch?v=daM7_pXeTH8, published Aug. 19, 2008, last visited Nov. 10, 2018.*
(Continued)

*Primary Examiner* — Garrett K Atkinson
(74) *Attorney, Agent, or Firm* — EcoTech Law Group, P.C.

(57) ABSTRACT

Apparatuses and methods are described to effectively improve posture. The devices include a bar that is mounted vertically to a floor. The devices may also include resistance bands and/or straps, such that a person may exercise their postural musculature while stabilizing their back. Devices for mounting the bar to the ground and to a wall are discussed. The mounting devices may also include portions for receiving resistance bands. The bars may also be arranged in front a mirror to provide a studio setting for group exercises.

9 Claims, 6 Drawing Sheets

(51) Int. Cl.

| | |
|---|---|
| ***A63B 21/00*** | (2006.01) |
| ***A63B 21/04*** | (2006.01) |
| ***A63B 21/16*** | (2006.01) |
| ***A63B 23/00*** | (2006.01) |
| ***A63B 23/02*** | (2006.01) |
| ***A63B 71/02*** | (2006.01) |
| ***A63B 21/055*** | (2006.01) |
| ***A63B 21/068*** | (2006.01) |

(52) U.S. Cl.

CPC ..... *A63B 21/0557* (2013.01); *A63B 21/068* (2013.01); *A63B 21/16* (2013.01); *A63B 21/169* (2015.10); *A63B 21/1681* (2013.01); *A63B 21/4035* (2015.10); *A63B 21/4043* (2015.10); *A63B 71/023* (2013.01); *A63B 21/0552* (2013.01); *A63B 2023/006* (2013.01); *A63B 2071/024* (2013.01); *A63B 2244/225* (2013.01)

(56) References Cited

U.S. PATENT DOCUMENTS 5,256,069 A * 10/1993 Snowden, Jr. ..... A63B 69/34 434/247
5,555,954 A * 9/1996 Swiderski ..... E04G 1/34 182/119
5,997,448 A 12/1999 Duba
6,494,817 B2 12/2002 Lake
6,652,419 B1 11/2003 Rota
7,060,002 B1 * 6/2006 Boehme ..... A63B 9/00 482/35
7,169,094 B2 * 1/2007 Ardito, III ..... A63B 21/04 482/121
7,617,780 B2 * 11/2009 Loebner ..... A63B 9/00 108/158.11
D631,518 S * 1/2011 Coote ..... D21/679
10,112,066 B2 * 10/2018 Heathfield ..... A63B 21/00069
2003/0047382 A1 * 3/2003 Panacci ..... E04G 5/00 182/113
2009/0178885 A1 * 7/2009 Heath ..... E04G 1/14 182/119
2010/0222150 A1 * 9/2010 Meyers ..... A63D 15/00 473/29
2010/0267522 A1 * 10/2010 Penney ..... A63B 6/00 482/33
2011/0237410 A1 9/2011 Perez
2012/0170293 A1 * 7/2012 Terry ..... F16M 11/10 362/431
2013/0052622 A1 * 2/2013 Calabrese ..... A63B 1/00 434/247
2014/0031182 A1 1/2014 Donofrio
2015/0310764 A1 * 10/2015 Rogers ..... G09B 19/0015 434/250
2017/0260810 A1 * 9/2017 Beaulieu ..... E04G 1/15
2017/0282045 A1 * 10/2017 Glasner ..... A63B 9/00
2018/0169455 A1 * 6/2018 Jarosz ..... A63B 9/00

OTHER PUBLICATIONS

Davis, Jennifer Marie PCT Application No. PCT/US2015/014000, Int'l Filing Jan. 30, 2015, International Search Report dated Apr. 6, 2015.

* cited by examiner

STUDIOS, DEVICES AND METHODS FOR EXERCISING OR IMPROVING POSTURE

RELATED APPLICATION

This application claims priority to U.S. Provisional Patent Application No. 61/934,768 filed on Feb. 1, 2014, which is incorporated in its entirety for all purposes.

TECHNICAL FIELD

The present teachings generally relate to studios, devices and methods for exercising. More specifically, studios, devices and methods of the present teachings provide posture improvement.

BACKGROUND ART

Good posture is an easy and important way to maintain a healthy body. Many people have poor posture, often exasperated by prolonged periods of sitting, which may result in permanently altering ones spinal structure. Thus, for example, slouching limits shoulder mobility, encourages neck/back pain and lowers hormone levels essential to productivity, positive mental health and personal progress.

In addition to health aspects, poor posture reflects on the esthetics of how one presents oneself, rounded shoulders, a sunken chest and a forward head weaken neck and back muscles promoting a double chin and a less-confident and less-youthful appearance.

There exists a need for devices and/or exercises that effectively promote proper posture.

DISCLOSURE

The present teachings provide, among other things, devices and/or studios for exercising and/or improving posture, and methods for exercising and/or improving posture.

One aspect of the present teachings provides an exercise device to effect posture improvement. The exercise device includes a bar having a first end and a second end and a first bracket. The first bracket includes: a first portion to mount the first bracket on a floor body, a second portion to receive the first end of the bar in an orientation that is substantially perpendicular to the floor body, and one or more portions to receive an exercise strap and/or resistance bands. The exercise device may further include a second bracket having: a first portion to mount the second bracket on the wall, and a second portion to accept the second end of the bar in an orientation that positions the bar substantially perpendicular to the floor body.

Another aspect of the present teachings provides a posture-improving studio including a floor and a wall. The studio includes: a plurality of bars each having a first end and a second end, and a mirror disposed on the wall. The first end of each of the plurality of bars is supported by a corresponding first bracket that is secured to the floor, each bar of the plurality of bars receives from partial to an entire body weight during exercise, and at least one first bracket includes one or more portions to receive resistance bands and/or straps that facilitate strengthening muscles for posture improvement. At least one bar of the plurality of bars may also be supported by a second bracket having: a first portion to mount the second bracket on the wall, a second portion to accept the second end of the bar in an orientation that positions the bar substantially perpendicular to the floor.

Yet another aspect of the present teachings is a method for a user to improve posture. The method includes using an exercise device, where the exercise device includes a bar having a first end and a second end and a first bracket. The first bracket includes: a first portion to mount the first bracket on a floor body, a second portion to receive the first end of the bar in an orientation that is substantially perpendicular to the floor body, and one or more portions to receive an exercise strap and/or resistance bands. The exercise device may further include a second bracket having: a first portion to mount the second bracket on the wall, and a second portion to accept the second end of the bar in an orientation that positions the bar substantially perpendicular to the floor body.

One aspect of the present teachings is a method to improve posture. The method includes: directing and/or assisting a subject to place back of head, back between the scapula/shoulders and sacrum against a bar, which extends from a floor to a height greater than the head of subject; and requesting and/or assisting the subject to move postural musculature as the bar provides posture stability.

Another aspect of the present teachings is a method to improve posture. The method includes: a user placing the back of head, the back between the scapula/shoulders and the sacrum against a bar, which extends from a floor to a height greater than the head of user; and the user moving their postural musculature as the bar provides posture stability.

Yet another aspect of the present teachings is a method to improve posture. The method includes: directing and/or assisting a subject to place back of head, back between the scapula/shoulders and sacrum against a bar, which extends from a floor to a height greater than the head of subject; and requesting and/or assisting the subject to stretch the postural musculature with resistance bands with the bar providing posture stability. The exercise device includes: a bar having a diameter and a length between a first end and a second end; and a first bracket. The first bracket includes a first portion to mount the first bracket on the ground, a second portion to accept the first end of the bar in an orientation that is substantially perpendicular to the ground, and one or more portions to support an exercise strap.

One aspect of the present teachings is a method to improve posture. The method includes: a user placing the back of head, the back between the scapula/shoulders and the sacrum against a bar, which extends from a floor to a height greater than the head of user; and the user moving the resistance bands to stretch the postural musculature with the bar providing posture stability. The exercise device includes: a bar having a diameter and a length between a first end and a second end; and a first bracket. The first bracket includes a first portion to mount the first bracket on the ground, a second portion to accept the first end of the bar in an orientation that is substantially perpendicular to the ground, and one or more portions to support an exercise strap.

Another aspect of the present teachings provides an exercise device to effect posture improvement. The exercise device includes a vertical bar and bands and/or straps. The vertical bar and bands and/or straps are located close enough so that a user may place their body against the bar and may grab, hold, or otherwise use the bands and/or straps for exercising. Thus, for example, the exercise device may include a bar and bands and/or straps that are affixed to, or otherwise immobilized by a floor, walls, ceiling, or some other structure that restrains them such that when a user leans of the bar and pulls on the bands and/or straps, the user is able to stretch their postural musculature with the bar providing posture stability.

The methods may, in general, be performed by a user (also referred to herein as a subject), an exercise facilitator, or by a combination, such as by an exercise facilitator instructing or assisting a user to perform the method.

These features together with the various ancillary provisions and features which will become apparent to those skilled in the art from the following detailed description, are attained by the apparatus and methods of the present invention, preferred embodiments thereof being shown with reference to the accompanying drawings, by way of example only, wherein:

Reference symbols are used in the figures to indicate certain components, aspects or features shown therein. Reference symbols common to more than one figure indicate like components, aspects or features shown therein.

MODES FOR CARRYING OUT THE PRESENT TEACHINGS

Figure 1A:
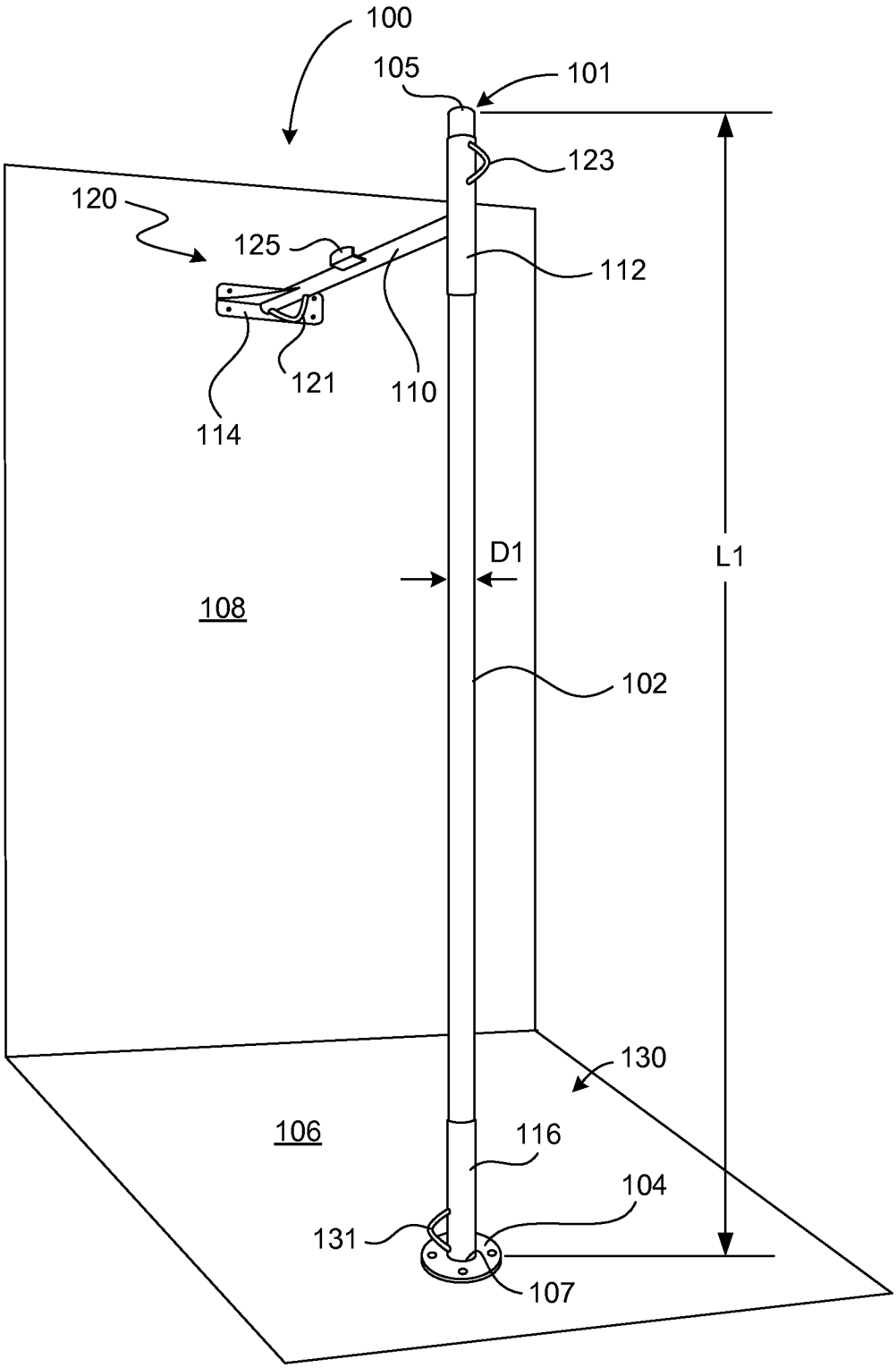
FIG. 1A shows a perspective view of an exercise space, according to one embodiment, and that includes a vertical bar assembly secured to the ground using a lower bar bracket and to the wall with a horizontal upper bar bracket.
Figure 1B:
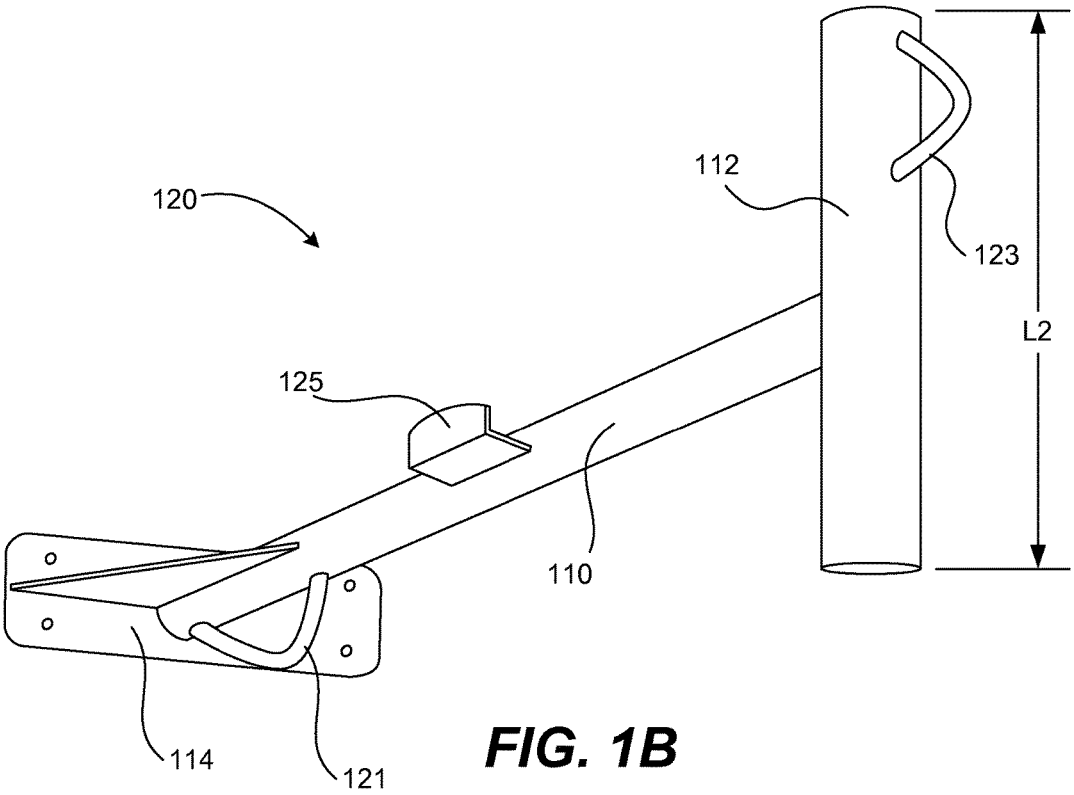
FIGS. 1B and 1C are a perspective view and a top view, respectively, of the embodiment of upper bar bracket shown in FIG. 1A.
Figure 1C:
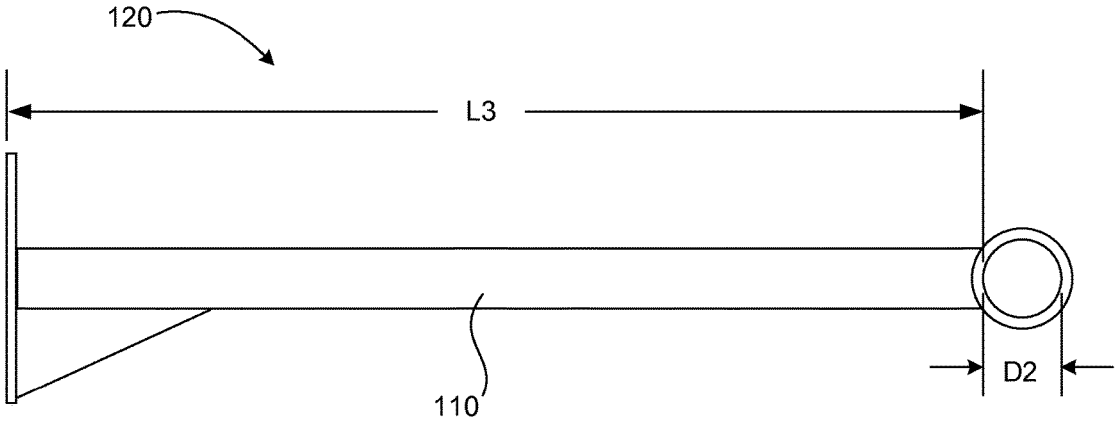
Figure 1D:
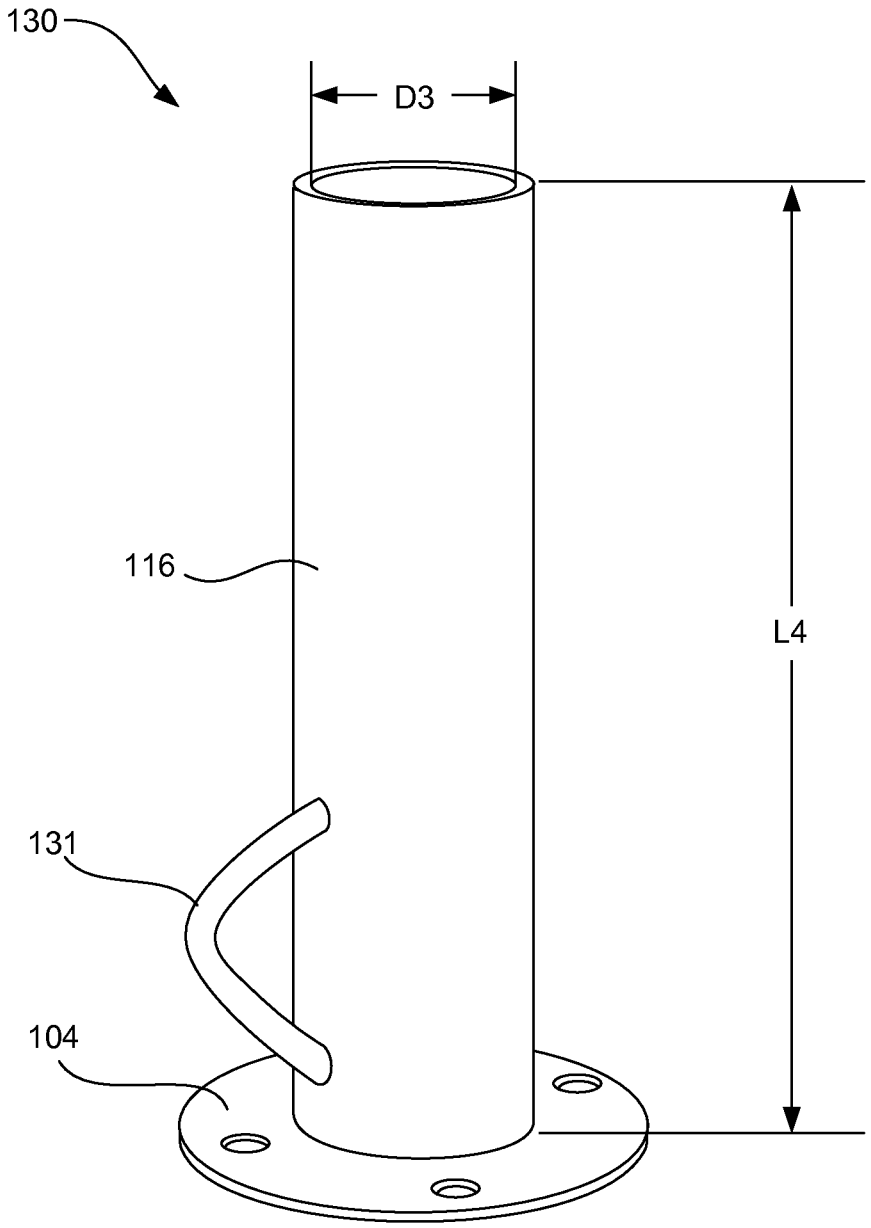
FIG. 1D is a perspective view of the embodiment of lower bar bracket shown in FIG. 1A.

FIG. 1A shows a fitness space 100, according to one embodiment of the present teachings. Fitness space 100 includes one or more assemblies generally similar to a vertical bar assembly 101, which fastens at a first end to a wall 108 and fastens at a second end to a floor body 106. Vertical bar assembly 101 includes an upper bar bracket 120, a bar 102, and a lower bar bracket 130. FIGS. 1B and 1C are a perspective view and a top view, respectively, of upper bar bracket 120, and FIG. 1D is a perspective view of lower bar bracket 130.

As shown in FIG. 1A, bar 102 includes a first end 105 and a second end 107. In a mating or engaged configuration, first end 105 relates to upper bar bracket 120 and second end 107 relates to lower bar bracket 130. Upper bar bracket 120, best seen in FIGS. 1A, 1B, and 1C, includes a spacer 110 and a sleeve 112, which receives first end 105 and a wall fastener 114. Lower bar bracket 130, best seen in FIGS. 1A and 1D, includes a sleeve 116 to receive second end 107 and a base fastener 104. In general, upper bar bracket 120 and lower bar bracket 130 are affixed to wall 108 and floor body 106, respectively. When bar 102 fits within sleeves 112 and 116, respectively, bar 102 is in a generally vertical orientation—that is perpendicular to floor body 106, and spaced from the wall by the length of spacer 110.

The term "bar" for bar 102 is not meant to be limiting as to the cross-sectional shape or as to any variation in the cross-sectional shape along the length of the bar. The outer surface of bar 102 and the inner surfaces of sleeves 112 and 116 are, however, formed of similar shape so that the bar may fit through and be held by the sleeves.

In one embodiment, the outer surface of bar 102 and the inner surfaces of sleeves 112 and 116 are generally cylindrical. In another embodiment, the surfaces may be square or have some other shape amenable to manufacturing and exercising. In yet another embodiment, the mating surfaces of bar 102 and sleeves 112 and 116 are cylindrical, or some other matching shape, while bar 102 between the sleeves has some other shape, such as a cylinder of a larger or smaller diameter. For sake of an example, the bar and sleeves are illustrated throughout the present specification and without limitation, as being generally cylindrical.

Vertical bar assembly 101 may, optionally, include devices for attaching additional exercise equipment. The devices may, for example be open or closed hooks or clasps that are on any part of the assembly, including but not limited to upper bar bracket 120 and/or lower bar bracket 130. Thus, for example and without limitation, FIG. 1A illustrates optional hooks or clasps 121 and 123 and hook 125 on upper bar bracket 120, and an optional hook or clasp 131 on lower bar bracket 130.

As described subsequently, especially in the discussion of FIG. 4, the hooks/clasps facilitate the performance of certain posture-related exercises. Thus, for example, while a user may perform posture related exercises by supporting their body against bar 102, they may, optionally, use bands and/or straps attached to vertical bar assembly 101 at a location that is on the ground or above their heads, depending on which hook/clasp the band/strap is attached to. The hooks/clasps thus provide the ability to perform a wider variety of posture-related exercises than would be possible without the hooks/clasps.

In the configuration of FIGS. 1A-1C, a portion of bar 102, which may include first end 105, passes through interior of sleeve 112 so that bar 102 and spacer 110 are coupled together. The present teachings offer the embodiment shown in FIGS. 1A-1C as an example, without any intention of limiting the manner in which the two components are coupled together. Other methods of coupling bar 102 and spacer 110 include using hardware, such as screws, nails, fasteners and/or pin connections. Furthermore, bar 102 and spacer 110 are preferably perpendicular to each other.

Spacer 110 is secured to wall 108 using wall fastener 114 and bar 102 is, similarly, secured to floor body 106 using base fastener 104. Although they need not be, wall fastener 114 and base fastener 104 may be similar in structure. In one embodiment of the present teachings, each of wall fastener 114 or base fastener 104 includes an end component that receives spacer 114 and bar 102, respectively. As the end component meets up with wall 108 or floor body 106, it takes the shape of a plate, which has apertures defined therein. The end component facilitates securing spacer 110 or bar 102 using screws or nails that pass through the apertures in wall 108 or floor body 106. As a result, vertical bar assembly 101 provides a stable structure that can withstand weight or force applied by a human being, for example, during a physical exercise routine. Vertical bar assembly 101 thus presents a rigid and unmoving bar surface for performing exercises.

In one embodiment, bar 102 is held in place relative to floor body 106 such that the bar provides a support to an exercising user of the bar, and a band and/or strap that is also held in place near the bar so that a user may pull on the band and/or strap. Thus, for example, in various alternative embodiments, upper bar bracket 120 is optional, lower bar bracket 130 is optional, upper bar bracket 120 and lower bar bracket 130 are optional. In other alternative embodiments, bar 102 and bands and/or straps may be held in place by a frame one the floor, walls or ceiling, the bands and/or straps may be held in place by being attached directly to or support by bar 102, with or without hooks/clasps, and/or a bottom end of bar 102 may be placed within a hole in the ground for support.

Figure 2:
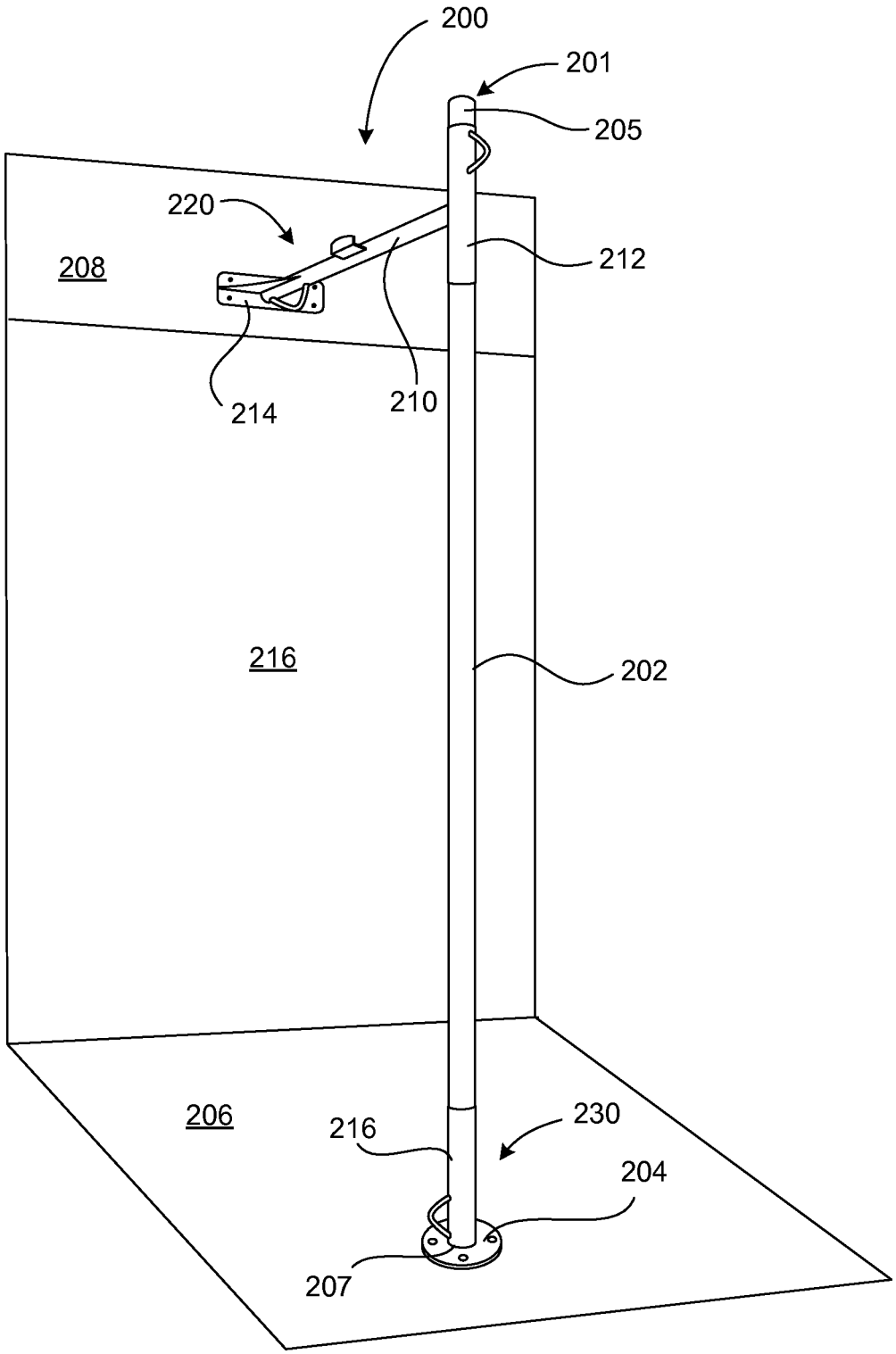
FIG. 2 shows a perspective view of the exercise space of FIG. 1A where a mirror is positioned adjacent to the vertical bar.

FIG. 2 shows an exercise space 200, according to an alternate embodiment of the present teachings. Exercise space 200 includes a vertical bar assembly 201, a first bar mount 220, and a second bar mount 230, a bar 202 having a first end 205 and a second end 207, a spacer 210, a sleeve 212, a base fastener 204, a sleeve 216, and a wall fastener 214, all of which are the same as or substantially similar to their counterparts, i.e., vertical bar assembly 101, first bar mount 120, second bar mount 130, bar 102 with first end 105 and second end 107, spacer 110, sleeve 112, base fastener 104, sleeve 116, and wall fastener 114, of FIGS. 1A-1D. In the configuration shown in FIG. 2, however, wall 208 has a mirror 216 attached thereto so that an exercising human subject can observe herself/himself during an exercise routine.

The elements of vertical bar assemblies 101 and 201 may be constructed of wood or a metal. Thus, for example, with reference to FIGS. 1B, 1C, and 1D, spacers 110 or 210 may have a length L3 (as shown in FIG. 1C) that may be from 0.3 m (12 inches) to 1.2 m (48 inches) in length, and may, for example and without limitation be approximately 0.3 m (12 inches), 0.45 m (18 inches), 0.6 m (24 inches), 0.75 m (30 inches), 0.9 m (36 inches), 1.05 m (42 inches), or 1.2 m (48 inches). Sleeves 112 or 212 may have a length L2 (as shown in FIG. 1B) that may be between 0.08 m (3 inches) and 0.3 m (12 inches) in length and constructed of metal, and may be for example and without limitation, approximately 0.08 m (3 inches), 0.15 m (6 inches), or 0.3 m (12 inches).

Bar 102 or 202, to the extent is of a cylindrical shape, may have a diameter D1 (as shown in FIG. 1A) of approximately 50 mm (2 inches) in diameter. Alternatively, D1 may be less than 50 mm, such as approximately 40 mm (1⅝ inches), may be from 40 mm to 45 mm, from 45 mm to 55 mm, or from 45 mm to 50 mm. The diameter D1 may also be greater than 55 mm, and may be approximately 90 mm or approximately 100 mm, or may, for example, be from 55 mm to 90 mm, from 50 mm to 100 mm, or from 90 mm to 100 mm. In one embodiment, bar 102 or 202 may have a length L1 (as shown in FIG. 1A) from first end 105/205 to second end 107/207 of from 1.2 m (4 feet) to 3.7 m (12 feet), and may, for example, be approximately 1.8 m (6 feet), 2 m (6.5 feet), 2.1 m (7 feet), or 2.4 m (8 feet). In those instances where the ceilings are extremely high, a portion of bar that extends beyond sleeve 112 or sleeve 212 may be long enough to reach the ceiling such that it is fastened there.

In certain embodiments, spacer 110/210, and/or upper bracket 120/220 are positioned at a height above ground that is greater than the height of the user of vertical bar assembly 101/201. Thus for example, spacer 110/210, and/or upper bracket 120/220 may be greater than 1.8 m (6 feet) above the ground, greater than 2 m (6.5 feet) above the ground, or greater than 2.1 m (7 feet) above the ground.

Wall fastener 114 or 214 shown in FIGS. 1A-1D and 2 may be constructed of metal and may be approximately 75 m (3 inches) high as measured vertically as mounted on the wall at its connection point (e.g., wall 108 of FIG. 1 and wall 208 of FIG. 2). Alternatively, the height may be from 50 mm (2 inches) and 100 m (4 inches). The width of wall fastener 114 or 214 may be approximately 0.3 m (12 inches) as measured horizontally as mounted on the wall at its connection point, or from 0.2 m (8 inches) and 0.4 m (16 inches) in width.

Base fastener 104 or 204 in these figures may be between 0.15 m (6 inches) and 0.3 m (12 inches) in length and may be between 0.1 m (4 inches) and 0.25 m (10 inches) in width at its connection points to the floor body (e.g., floor body 106 of FIG. 1 and floor body 206 of FIG. 2).

In accordance with one embodiment of the present arrangement, mirror 216 of FIG. 2 may extend from floor body 206 to or near the ceiling of exercise space 200. By way of example, mirror 216 is between 0.3 m (1 foot) and 0.2 m (8 feet) in width and may be any height from floor body 206 to ceiling of exercise space 200.

Figure 3:
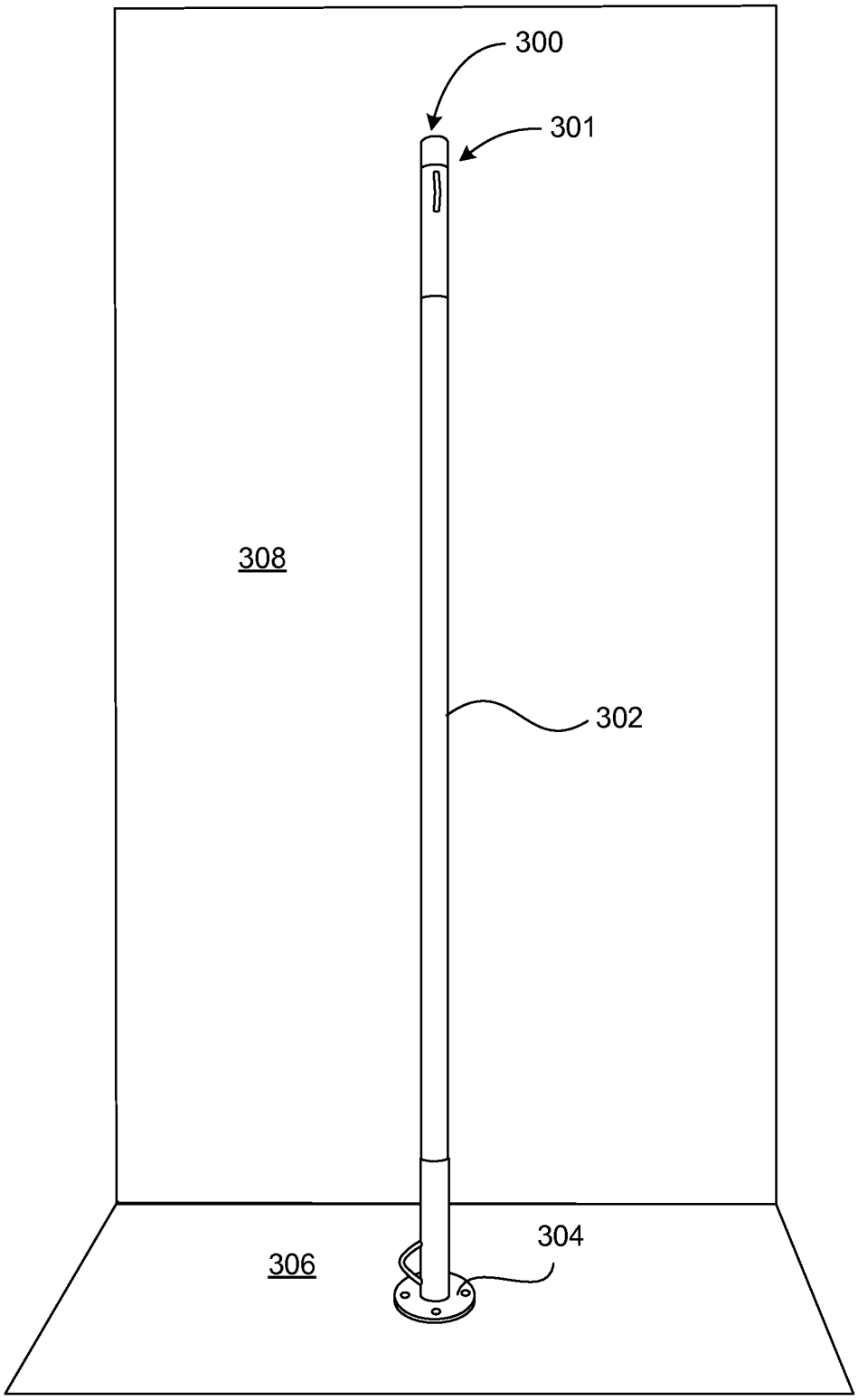
FIG. 3 shows an exercise space, according to another embodiment of the present teachings and that includes a vertical bar of a different arrangement than that shown in FIGS. 1A and 2.

FIG. 3 shows an exercise space 300 includes a wall 308, a floor body 306 and a bar 302 that is coupled to floor body 306 using a base fastener 304. Bar 302 is the same as or substantially similar to bar 102 of FIG. 1A or bar 202 of FIG. 2. In one preferred embodiment of the present teachings, wall 308 includes a mirror similar to mirror 216 of FIG. 2. Regardless of whether a mirror is used, bar 302 stands in the absence of a spacer, such as the one shown in FIG. 1A or 2.

Although FIGS. 1A, 2 and 3 describe different embodiments of an exercise space, they also provide novel designs of a vertical bar assembly or bar that may be used during an exercise routine. As a result, the present teachings are not limited to an exercise space, rather extend to cover a vertical bar assembly or bar.

Figure 4:
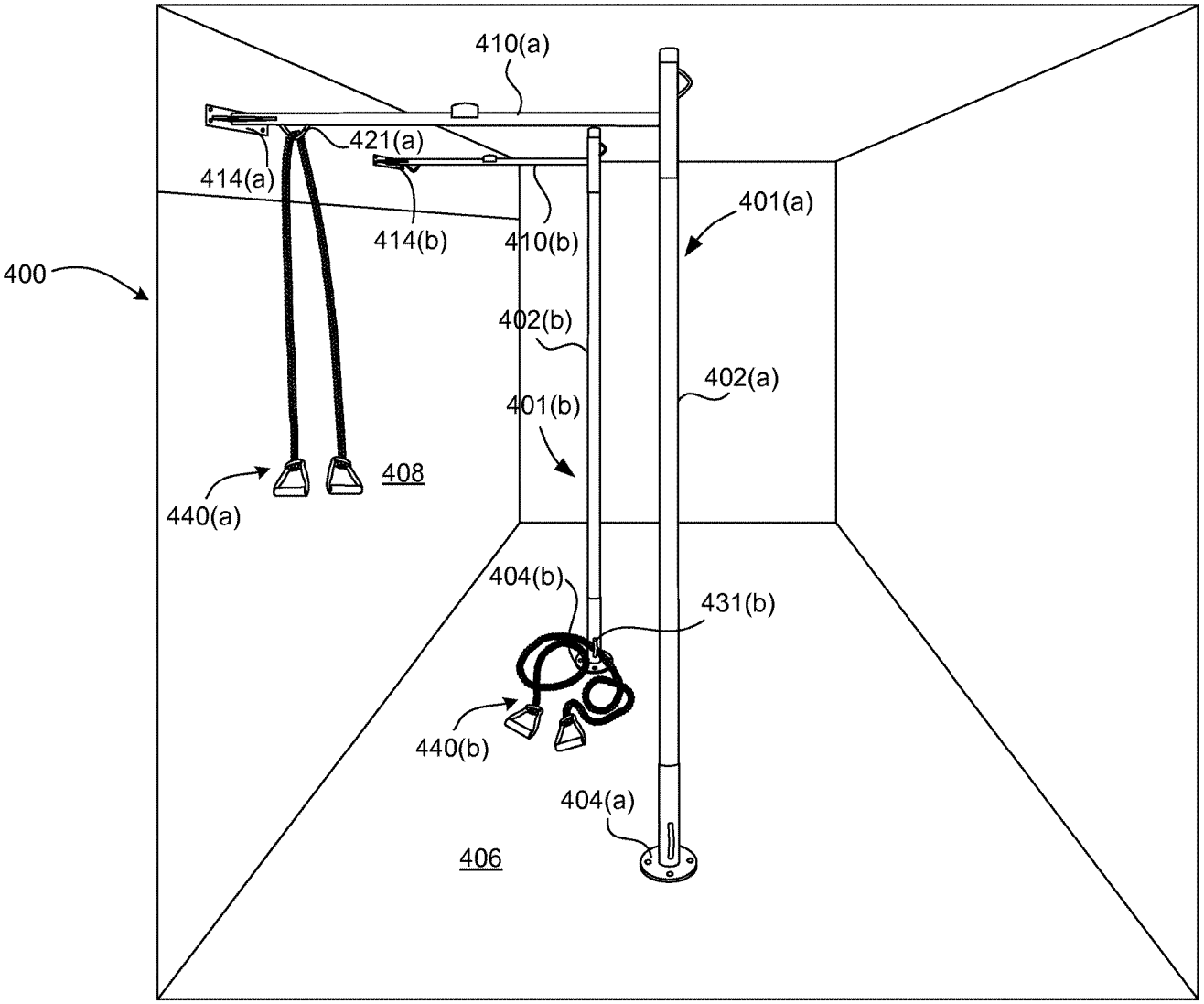
FIG. 4 shows an exercise studio, according to one embodiment of the present teachings and that includes multiple exercise spaces, each of which use a vertical bar.

FIG. 4 shows an exercise studio including multiple vertical bar assemblies, e.g., 401(*a*), 401(*b*) disposed before a wall or mirror 408 and a floor body 406. In one preferred embodiment, mirror 408 is a single mirror that multiple users of vertical bar assemblies may use to observe themselves. Exercise studio may or may not include a video monitor or multiple video monitors to observe further instruction. Vertical bar assemblies 401(*a*), 401(*b*) include a bars 402(*a*), 402(*b*), spacers 410(*a*), 410(*b*), preferably having sleeves 412(*a*), 412(*b*), a base fastener 404(*a*), 404(*b*) and a wall fastener 414(*a*), 414(*b*), respectively. Each of the vertical bar assemblies shown in FIG. 4 may be the same as substantially similar to vertical bar assembly 101 or 201 of FIGS. 1A-1D and 2, respectively. In another alternative embodiment of the present teachings, each of multiple bar assemblies shown in FIG. 4 is similar to bar 302 of FIG. 3. In certain embodiments of the present arrangements, FIG. 4 may have some vertical bar assemblies that are similar to vertical bar assembly 101 or 201 of FIG. 1 or 2, and may have other vertical bar assemblies that are similar to bar 302 of FIG. 3.

In an alternative embodiment, vertical bar assembly 101, 201, 301, and/or 401 include portions that may support additional exercise equipment. In the following example, the portions are hooks or clasps the may be part of the vertical bar assembly.

FIG. 4 illustrates the use of additional exercise equipment, as bands or straps 440, which may be used in combination with the bar 402(*a*) or 402(*b*). Thus FIG. 4 shows a hook 421(*a*), which is generally similar to hook 121 and which has attached bands 440(*a*), and hook 431(*b*), which is generally similar to hook 131 and which has attached bands 440(*b*). Bands 440 may include elastic or inelastic bands and may, for example and without limitation, be looped through hooks, such as hooks 421(*a*) and 431(*b*), or may be attached to the hooks with carabiners. The bands may be, for example, single or braided bands or tube, with or without a fabric cover, and with or without handles or stirrups or other devices for supporting the body at their ends. See for example, the line of elastic bands manufactured by SPRI Products, Inc. (Libertyville, Ill.), as shown at http://www.spri.com/rubber-resistance/. In other embodiments, instead of bands, hooks or clasps may be used to secure straps.

A method of exercising, in accordance with one embodiment of the present teachings, using any one of vertical bar assemblies 101, 201, 301, or 401 may begin with applying a force on the vertical bar using one or more contacting human body parts and/or muscle groups, such that the vertical bar stabilizes one or more of the contacting body parts. Contacting body parts are those that contact the vertical bar. Next, the method may include moving, simultaneously, one or more non-contacting human body parts, which parts do not contact the vertical bar, and wherein the contacting and the non-contacting human body parts include any one of bone or muscle. When the human contacting body parts apply a force on the bar, the bar, in turn, exerts a substantially equal and opposite force on one or more of the contacting body parts, to stabilize the human during an exercise routine. The bones may preferably include a skeleton in one embodiment of the present teachings. The body movements may include both open-chain and closed-chain exercises. The body movements may include both maximal and sub-maximal muscular contractions.

The muscular contractions may produce, but are not limited to, isometric, eccentric and concentric muscle contractions of the contacting and the non-contacting human body parts. Vertical method of exercising utilizes a vertical fitness apparatus as both (1) exercise support and (2) spinal alignment reference. Further, the devices of the present invention allow for a large range of motion, allowing the body to twist to exercise in all plains (frontal, sagittal and transverse) without obstruction.

As exercise support, the vertical apparatus is a stabilizing force to connect with the body as both a vehicle of resistance and assistance to engage both global and stabilizing muscles by pushing against the bar while lifting an arm or leg appendage weighted by resistance or free weight, by pulling against the bar during squat, chair and lunge like exercises and while holding onto the bar maintaining balance during traditional Yoga-like poses.

EXERCISE EXAMPLES

Several examples of exercises are presented as being performed on the device and in the studio of FIG. 4. It is understood that this is by way of example, and one skilled in the art would understand that the exercises could be performed using any one of vertical bar assembly 101, 201, 301, or 410. In the following examples, a user exercises on their own or by following instructions or guidelines of an exercise facilitator.

As one example of an exercise using vertical bar assembly 401, a resistance band is attached to hook 431 at the base and the exerciser with a foot or ankle strap. The exerciser may then exercise by pushing against vertical bar 402 with wide hand grip, with the shoulders parallel to bar, and with a substantial part of the body parallel to floor. This exercise will strengthen core posture muscles and intricate hip complex musculature.

In another example, the exerciser positions themselves with the three body parts of contacting vertical bar 402*a*, from top to bottom: (1) the back of head (2) the back, between the scapula/shoulders, and (3) the sacrum. With these three body parts contacting vertical bar while facing mirror 408, and with a resistance band 440(*a*) attached to upper bar support 410 (*a*), as at hook or clasp 421(*a*), for example, the exerciser then pulls/stretches the resistance band to his body then releases the band, exercising postural musculature as the bar behind him ensures standing posture stability.

In another example, vertical bar 401 acts as a restorative device, permitting the human body to return to its natural architecture of aligned standing posture by connecting the body at 3 points along the bar to quiet larger/global muscle groups, thus encouraging the smaller/stabilizing muscle groups to engage thus develop and grow.

It is to be understood that the invention includes all of the different combinations embodied herein. Throughout this specification, the term "comprising" shall be synonymous with "including," "containing," or "characterized by," is inclusive or open-ended and does not exclude additional, unrecited elements or method steps. "Comprising" is a term of art which means that the named elements are essential, but other elements may be added and still form a construct within the scope of the statement. "Comprising" leaves open for the inclusion of unspecified ingredients even in major amounts.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention.

I claim:

1. A posture-improving studio including a floor and a wall, said studio comprising:

a plurality of vertically oriented bars each having a first end a second end and being configured to support a user's body weight;

a plurality of first brackets, each supporting the second end of a corresponding one of the bars and being secured to the floor;

a plurality of second brackets, each having a first portion and a second portion, wherein said first portion mounts to the wall;

a plurality of spacers, each of which includes a wall end and a bar end, and the wall end of one of said spacers is coupled, at said second portion, to a corresponding one of the second brackets, and the bar end of one of said spacers is coupled, at or near the first end, to the corresponding one of the bars, such that in a vertical orientation of corresponding one of the bar relative to the floor, the corresponding bar is spaced away from the wall by a length of one of said spacers;

a plurality of first clasps, each of which being disposed, at a location that is proximate to the corresponding one of the second brackets, on one of the spacers, and wherein each of plurality of the first clasps is configured to receive band and/or strap for exercising; and a mirror disposed on the wall.

2. The posture-improving studio of claim 1, wherein at least one bar of said plurality of bars is a cylindrical bar having a diameter.

3. The posture-improving studio of claim 2, wherein said diameter is between 40 mm and 55 mm.

4. The posture-improving studio of claim 2, wherein said length of at least one bar of said plurality of bars is from 1.2 m to 3.7 m.

5. The posture-improving studio of claim 1, wherein plurality of said first clasps point downward to the floor, and downward orientation allows said first clasps to provide bands and/or straps in a suspended state from the spacer.

6. The posture-improving studio of claim 1, further comprising a plurality of first sleeves, each of which is designed to receive, at a first location, the first end of corresponding ones of the bars, and, at a second location, couples to or includes the spacer that extends in a direction that is perpendicular to corresponding one of the bars.

7. The posture-improving studio of claim 1, further comprising a plurality of second clasps, each disposed at or near the first end of corresponding one of the bars.

8. The posture-improving studio of claim 1, wherein one of spacers has a length that is between 12 inches and 48 inches.

9. The posture-improving studio of claim 1, wherein relative to the floor, a height of said spacer is a distance that ranges from 6 feet to the ceiling of the posture-improving studio.

* * * * *